US005345977A

United States Patent [19]

Stacher

[11] Patent Number: 5,345,977

[45] Date of Patent: Sep. 13, 1994

[54] GRIPPER LOOM HAVING WARP THREAD BEARER MEMBERS

[75] Inventor: Angelo Stacher, Arbon, Switzerland

[73] Assignee: Sulzer Rueti AG, Rueti, Switzerland

[21] Appl. No.: 55,124

[22] Filed: Apr. 29, 1993

[30] Foreign Application Priority Data

Jun. 12, 1992 [EP] European Pat. Off. ..... 92 810455.3

[51] Int. Cl.[5] ..... D03D 47/12; D03D 47/27

[52] U.S. Cl. ..... 139/449

[58] Field of Search ..... 139/449, 441, 444–447

[56] References Cited

U.S. PATENT DOCUMENTS

| | | | |
|---|---|---|---|
| 4,834,146 | 5/1989 | Pezzoli | 139/449 |
| 4,977,932 | 12/1990 | Pezzoli | 139/449 |
| 5,035,268 | 7/1991 | Bucher | 139/449 |
| 5,135,033 | 8/1992 | Stacher et al. | 139/449 |
| 5,176,185 | 1/1993 | Rheinganz et al. | 139/449 |

FOREIGN PATENT DOCUMENTS

| | | |
|---|---|---|
| 0352223 | 1/1990 | European Pat. Off. . |
| 0446561 | 9/1991 | European Pat. Off. . |
| 0468916 | 1/1992 | European Pat. Off. . |
| 679808 | 8/1939 | Fed. Rep. of Germany . |

*Primary Examiner*—Andrew M. Falik
*Attorney, Agent, or Firm*—Townsend and Townsend Khourie and Crew

[57] ABSTRACT

A rapier tape gripper loom having inserter rapier tapes driving inserter and taker gripper heads has the warp threads only provide gripper head support over at least part of the insertion path. The insertion path occupies a width of the shed defined by the path of insertion and retraction of the gripper heads. It is the warp threads of the lower shed which act exclusively as direct support to the gripper heads over the part of the insertion path. During the insertion of the weft yarn, at least one bearer member supports the warp threads alongside of but not in the insertion path. This support effected by the at least one bearer member is outside the insertion path over which the gripper heads travel, leaving the warp threads as adjacently supported by the bearer member as the sole supporting members for the gripper heads.

12 Claims, 3 Drawing Sheets

Fig.1
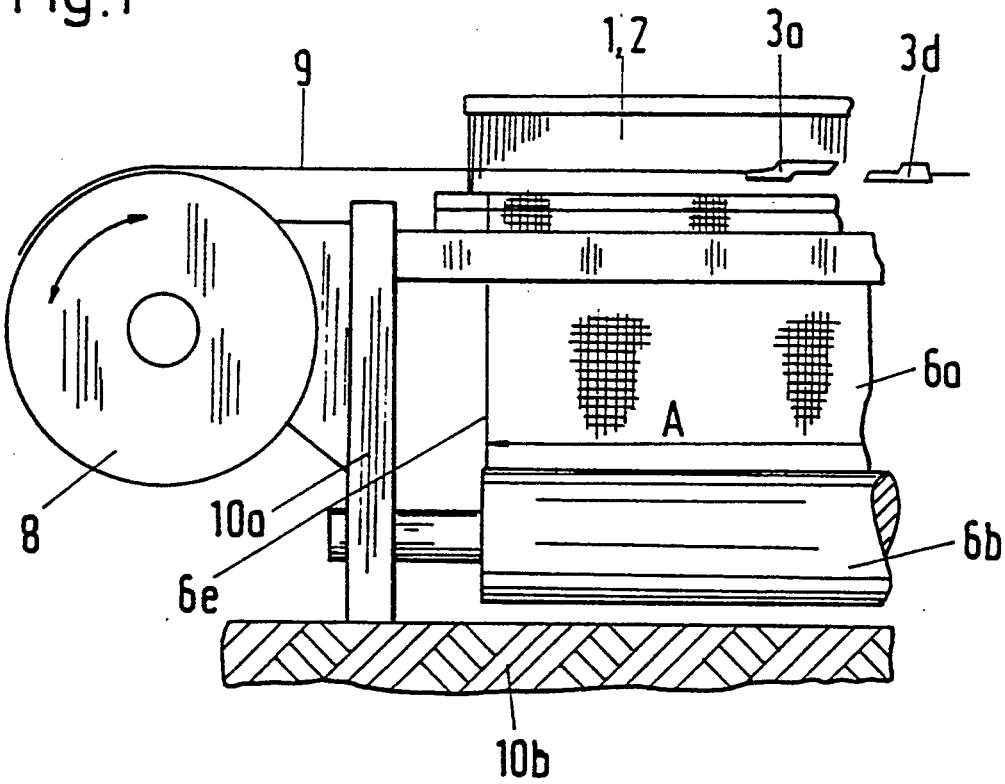
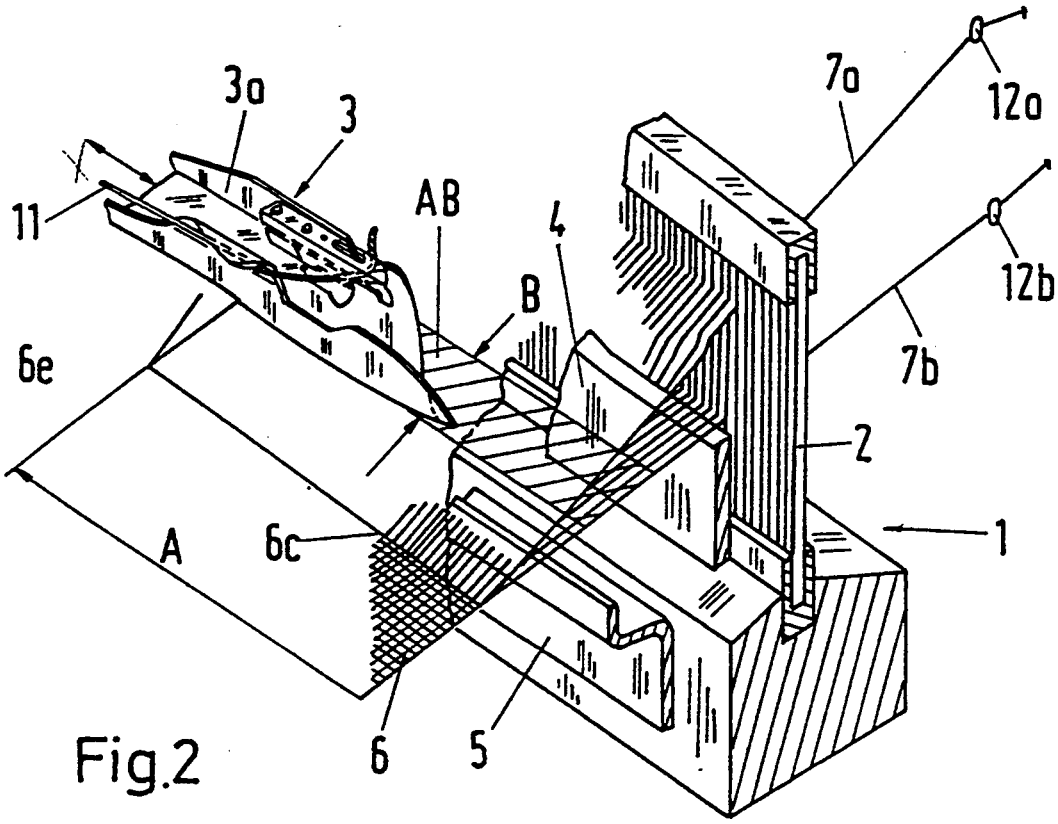
Fig.2

GRIPPER LOOM HAVING WARP THREAD BEARER MEMBERS

The invention refers to a gripper loom, especially a rapier tape gripper loom with insertion rapier tapes and gripper bodies having warp thread supports outside of the path of insertion and retraction of the gripper head.

STATEMENT OF THE PROBLEM

In the gripper looms widely distributed today a bringer gripper inserts the weft yarn into the middle region of the shed, where it is taken over by a taker gripper. As shown in the EP 0 352 223 the warp threads are usually laid on a guide track and the gripper bodies are slid by their insertion rapier tapes over the warp threads supported by means of the guide track. The warp threads in the region of the weft insertion are therefore subjected to mechanical loading the result of which may be damaged or severed warp threads. Apart from the supporting guide track there are within the shed no guide devices acting directly upon the gripper, so that it is solely the insertion rapier tapes which act upon the grippers to determine their direction and guide them.

The force acting via the insertion rapier tape for accelerating or braking the respective gripper does not engage absolutely with the center of gravity of the gripper, or the gripper's sliding face or the guide track exhibit, e.g., unevennesses, in particular because of deposits of dirt, the consequence of which is that at intervals the gripper rises from the base supporting it and flies through the open shed. Thus, for example, in a first phase of insertion a gripper may fly over the warp threads, only to slam down onto the warp threads during braking and slide on them up to transfer of the weft yarn. The impact of the gripper causes injured, bruised warp threads or makes shiny places in the cloth. In particular towards the middle of the length of cloth a risk exists of severe soiling of the cloth since particles caused by friction, such, e.g., as slivers of yarn, are deposited in the warp threads in the region of the gripper as it slams down, slides, is braked or changes its direction of motion. The particles caused by friction lie especially on the surface of the guide track so that the respective warp threads are pressed into the particles through the weight of the gripper and become soiled. But soiling of the warp threads may also occur on the side next the gripper since the gripper slides directly on the warp threads and hence particles caused by friction may be forced into the warp threads.

A circumstance that further contributes to soiling of the cloth is that after transfer of the yarn has been effected the gripper as it slides over the warp threads within the shed is being accelerated in the direction of the rapier tape drum. Since the warp threads are lightly clamped between the gripper head and the guide track at the time, the gripper heads running out at high acceleration, especially in the region of the middle of the weave, cause a force to act upon the warp threads in the direction of withdrawal, so that predominantly the warp threads lying in the middle of the weave experience a deflection acting transversely to their alignment, which makes the warp threads slide to and fro on the supporting guide track during the repeated weft yarn insertion. Besides possible damage to the warp threads this transverse movement of the warp threads caused by frictional forces engaging them directly, brings about additional soiling of the warp threads, in particular in the middle of the weave and thereby soiling of the cloth.

In the EP 0 446 561 elements for maintaining pitch in gripper looms are disclosed, which penetrate between the warp threads and support a gripper sliding in the shed in such a way that it does not come to lie on the warp threads. But the pitch-maintaining elements entering the open shed from below may in doing so injure warp threads. Therefore there are fabrics which cannot reliably be woven with pitch-maintaining elements penetrating them, for example, fabrics with a high warp thread density such as very fine fabrics with a density in the range of 190 warp threads per cm. Again, the disadvantage persists that the pitch-maintaining elements entering certain weaves cause streakiness in the warp, the consequence of which is irregularities in the appearance of the goods. The problem of the present invention is to eliminate or at least reduce the interaction between grippers, warp threads and guide track in such a way that injuries to the yarn and soiling of the yarn by grippers or guide track do not occur or occur less often.

SUMMARY OF THE INVENTION

The insertion rapier tapes usually exhibit great stiffness in the horizontal direction whereas in the vertical direction they are very flexible so that the insertion rapier tape may be wound round a rapier tape drum. At high warp thread densities, for well known reasons pitch-maintaining elements entering the shed must be waived. It therefore cannot be avoided that the grippers and also under certain circumstances the insertion rapier tapes cover at least parts of their travel during insertion and withdrawal, sliding upon the warp threads. Equally it often cannot be avoided that the gripper during the insertion phase of the weft yarn drops with a bump on the warp threads. In the present invention the warp threads are protected by the warp threads which are in the lower shed at the time, being resiliently supported.

At least in the area over which bringer or taker grippers slide in contact with the warp threads, the warp threads of the lower shed are supported resiliently, preferably in the direction of gravity. For doing that the warp threads may in this area be supported elastically by, for example, the supporting hard surface of the guide track being coated with an additional elastic layer or by the whole guide track consisting of an elastic material so that the warp threads of the lower shed are supported elastically at least in the direction of gravity. This kind of execution of the guide track is suitable even for supporting a gripper with the loom at standstill, e.g., by the guide track under the warp threads lying offset slightly in the direction of gravity and only carrying the gripper with the loom at standstill.

A further possibility of achieving yielding properties in the area mentioned consists in supporting the warp threads only outside the area swept by the grippers. An appropriate supporting member may be realized, for example, as narrow warp-thread bearer rails which support the warp threads in parallel with the direction of motion of the grippers outside the swept area. In the case of bearer rails which are inelastic or not very elastic, for example, metallic bearer rails, it is predominantly the elastic properties of the warp threads which bring about the resilient properties in the swept area. Naturally the bearer rails may also be created in such a way that they have yielding properties, e.g., by plastics having the elasticity of rubber being employed.

Again, the devices supporting the warp threads of the lower shed may be combined, for example, by the warp threads of the lower shed in the region in the middle of the weft yarn insertion within which the grippers definitely slide on these warp threads, being supported by bearer members of the kind which engage outside the swept area, whereas in both regions towards the respective selvedges a guide track supports the warp threads.

BRIEF DESCRIPTION OF THE DRAWINGS

The invention is described below with the aid of embodiments. There is shown in:

FIG. 1 —the elevation of one half of a gripper loom, seen from the cloth side;

FIG. 2 —a section of a sley with bearer members in accordance with the invention and a gripper head;

DESCRIPTION OF THE PREFERRED EMBODIMENT

Figure 3:
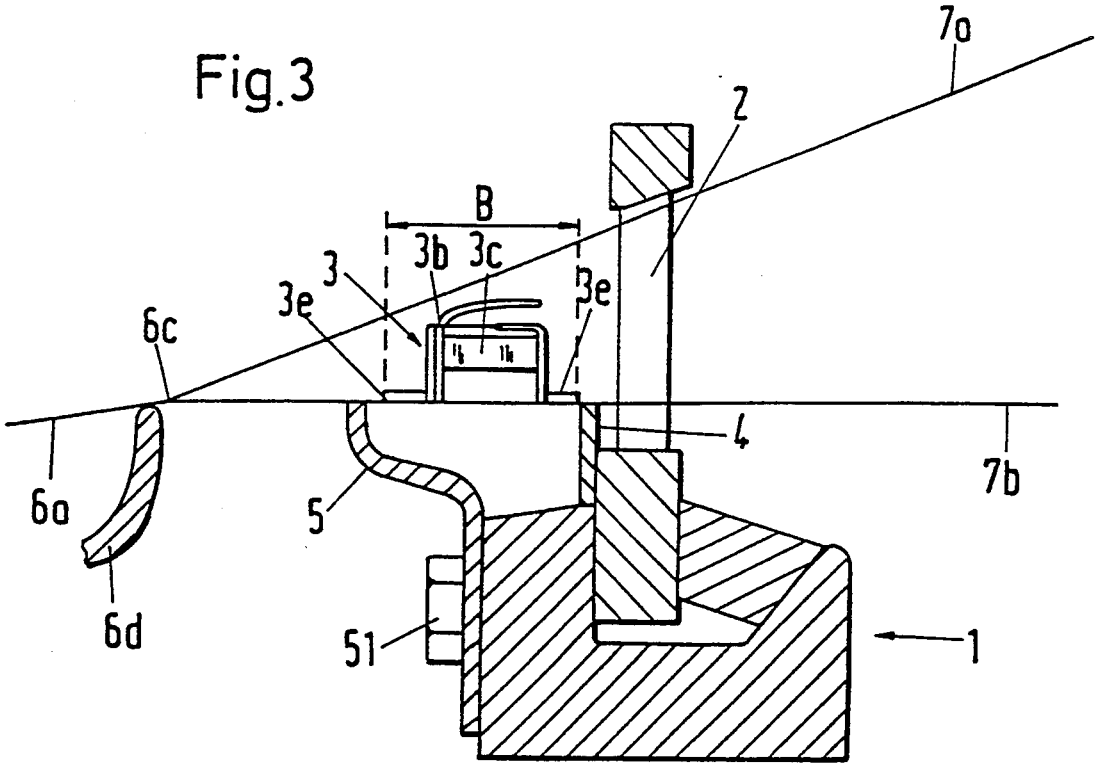
FIG. 3 —a cross-section through the shed and the sley with bearer members.

In FIG. 1 a rapier tape gripper loom is represented with a sley 1 and a reed 2. The rapier tape drum 8 moves the bringer gripper head 3*a* which is connected to the rapier tape drum 8 via the insertion rapier tape 9, to and fro in the shed. The taker gripper head 3*d* moves in the opposite sense to the bringer gripper head 3*a* and takes over the weft yarn each time in the middle of the weave. The frame 10*a* of the loom and the base 10*b*, the cloth 6*a* with a slevedge 6*e* and the width of the cloth shown by A, as well as the cloth beam 6*b* are also represented.

The perspective in FIG. 2 shows a sley 1 to which are fastened a reed 2 and two bearer members 4, 5 for supporting the warp threads 7*b* of the lower shed. The heald eyes 12*a* and 12*b* determine at any time the angle of opening of the shed formed by the warp threads 7*a* and 7*b*. A bringer gripper head 3*a* is also shown, which inserts a weft yarn 11 into the shed formed by the high level warp threads 7*a* and the low level warp threads 7*b*. The bringer gripper head 3*a* is shown slightly enlarged in comparison with the sley 1. For the sake of clarity the taker gripper head 3*d* is not shown which would approach inside the shed in the opposite direction to the bringer gripper head 3*a*. The width of the cloth 6 is designated by A. The bringer gripper head 3*a* which has a width B in the direction of the warp threads rests across its whole width B on the lowlevel warp threads 7*b*. The area AB is an area of length A and width B and designates that zone of the lowlevel warp threads 7*b* over which the two gripper heads 3*a*, 3*d* slide or fly during each weft yarn insertion. At the latest towards the middle of the weave the two gripper heads 3*a* and 3*d* lie on the low level warp threads 7*b* and slide into one another, whereupon the yarn 11 is taken over by the taker gripper head 3*d* and thereupon the two gripper heads 3*a* and 3*d* are pulled out of the shed by the insertion rapier tapes 9, sliding mainly on the warp threads 7*b*. No guide elements are provided inside the shed for the gripper heads 3*a* and 3*d*, so that the direction of insertion of the gripper heads 3*a* and 3*d* is determined mainly by the insertion rapier tapes 9 which are stiff in the direction of the cloth beat-up. The position of the area AB on the lower warp threads 7*b* is therefore determined mainly through the arrangement of the rapier tape drums 8 and insertion rapier tapes 9 and at least in the direction of the cloth beat-up always remains approximately at the same place whereas the low level warp threads 7*b* move during the weaving process in the direction of beat-up. The width B of the region within which the gripper heads 3*a* and 3*d* slide or fly over the warp threads may also be greater than the effective width of a gripper head 3 since the insertion rapier tapes 9 are affected by play in the direction of beat-up. This play of the gripper heads 3 in the direction of the warp threads has the effect that the width B of the area AB swept by the gripper heads may become slightly greater than the effective width of the gripper heads 3. For supporting the warp threads 7*b* the bearer member 4 is arranged as a bearer rail adjoining the reed 2 on its beat-up side and running in parallel with it. The second bearer member 5 is fastened to the sley 1 offset and parallel with the beat-up edge 6*c* of the cloth, in such a way that the warp threads 7*b* of the lower shed are supported only outside the area AB by the bearer rails 4 and 5.

A gripper head 3 which during weft yarn insertion drops onto the warp threads 7*b* is damped springily by their not being supported within the region of the area AB. In that case it has to be taken into consideration that the warp threads 7*b* are preferably deflected only within their elastic range, which means that an appropriate number of warp threads 7*b* of an appropriate tensile strength must be present in the lower shed. For strong loadable warp threads such as those employed, e.g., in the production of wire cloth a correspondingly small number of supporting warp threads 7*b* is necessary in the lower shed. On the other hand, in the case of very fine weaves a correspondingly large number of supporting warp threads 7*b* is necessary.

In completion of FIG. 2 FIG. 3 shows a cross-section through a similar arrangement. In supplement a cloth-supporting rail 6*d* is shown for supporting the cloth 6*a* in the region of the cloth beat-up edge 6*c*, as well as fastener means 51 for fastening and setting the position of the warp thread bearer rail 5 on the sley 1. The gripper head 3 differs from the embodiment represented in FIG. 2. From the cross-section a gripper head 3 having a housing 3*b* and inner components 3*c* may be seen. The housing 3*b* lies like a sledge with two runners 3*e* on the warp threads 7*b*. One advantage of this execution of gripper may be seen, for example, in that the width B sweeping the warp threads 7*b* may be chosen wider than the actual gripper housing 3*b*. The gripper 3 thereby slides over the warp threads 7*b* in a more stable manner. During at least one part of the weft yarn insertion the warp threads 7*b* rest on the warp thread bearer rails 4 and 5 and are lowered, coupled with the beat-up movement of the sley 1, in order after the change of shed has been effected to support the low level warp threads 7*b* again during the next weft yarn insertion.

The warp thread bearer rails 4 and 5 are represented in the present embodiment as separate elements. Naturally a U-shaped element the two arms of which running in parallel exhibit at least a separation B, can fulfill the same function as the two separate bearer rails 4 and 5.

Figure 4:
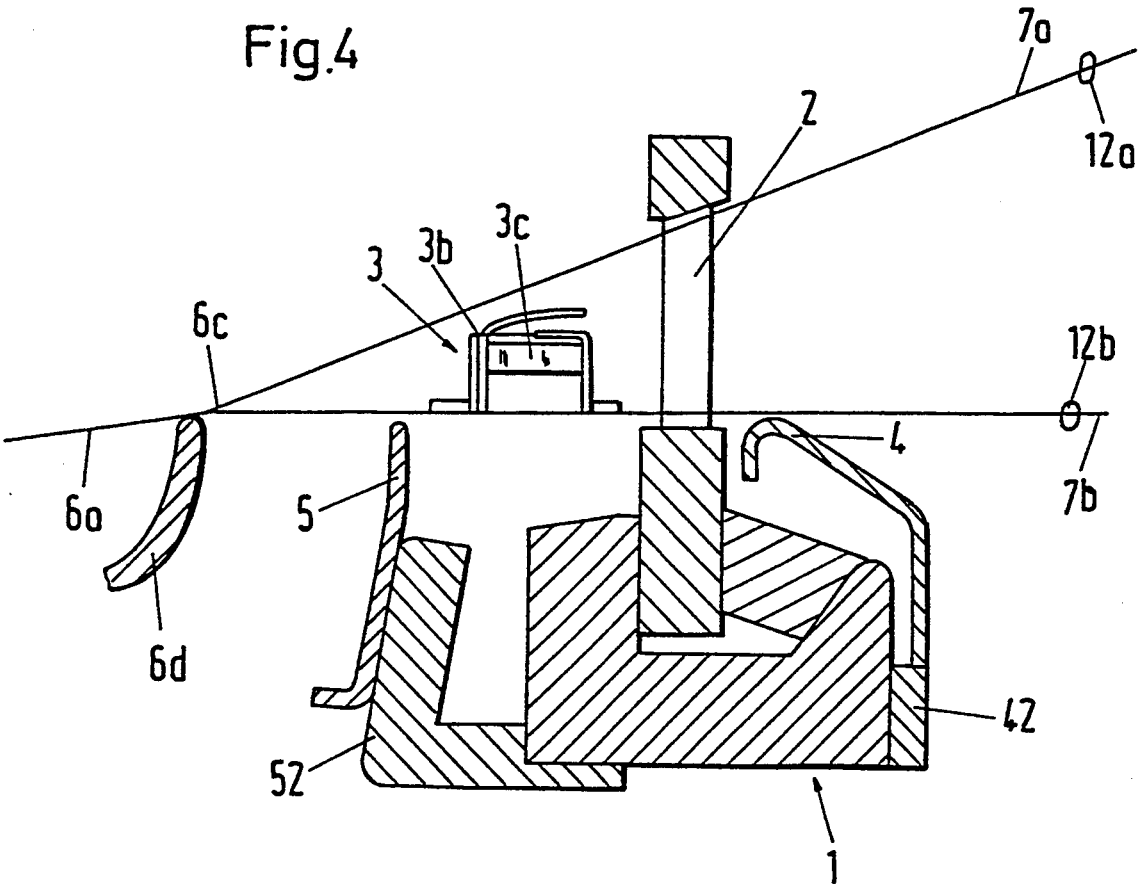
FIG. 4 —a further cross-section through a shed with sley and bearer members.

In FIG. 4 a further possibility is represented for supporting the low level warp threads 7*b*. The warp threads 7*b* are supported against the direction of gravity primarily by the cloth supporting rail 6d as well as the heald eyes 12b which guide the warp threads of the lower shed. Only from a certain loading or bending respectively of the warp threads 7b do the warp thread bearer rails 4 and 5 in the embodiment represented take over a supporting function. The bearer member 4 is fastened to the sley 1 by a fastener 42 on the side next the heald eye 12b. The bearer member 4 may also be connected rigidly to the loom frame 10a (see FIG. 1) in the position shown, so that only the bearer member 5 lying between the sley 1 and the cloth beat-up edge 6c and coupled to the sley 1 executes with it each beat-up movement.

Figure 5:
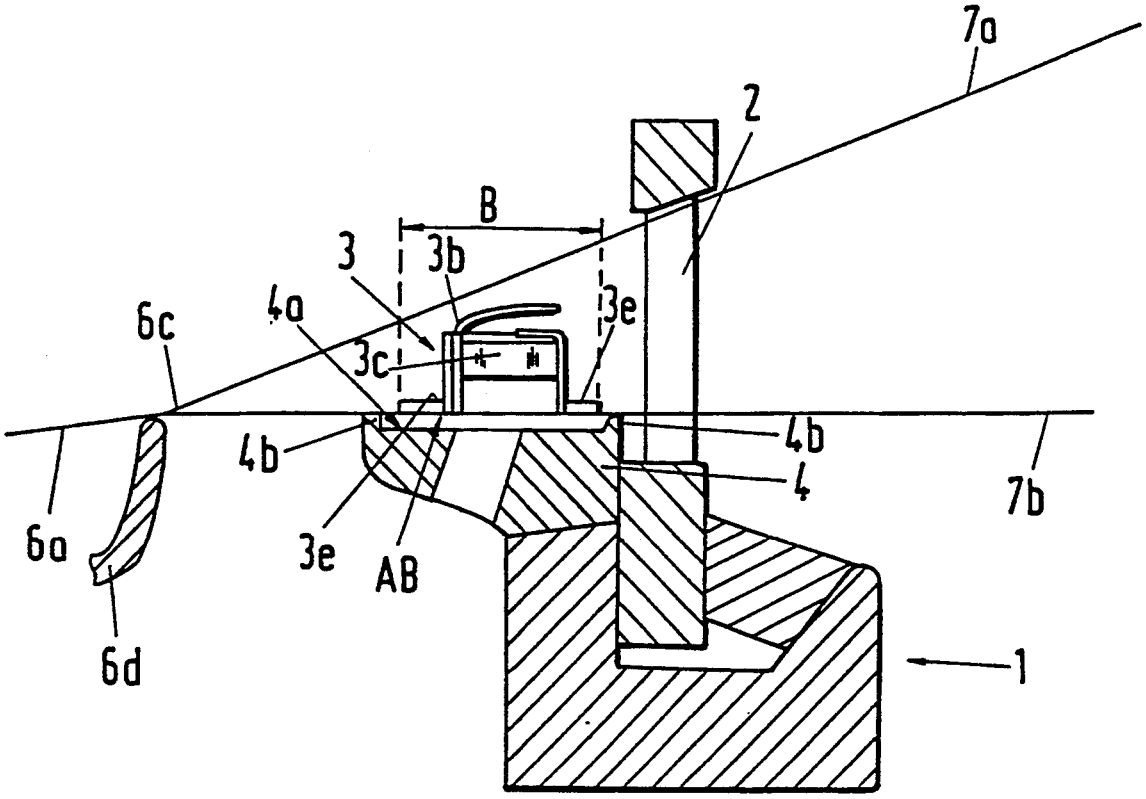
FIG. 5 —a further cross-section through a shed with sley and a U-shaped bearer member.

In FIG. 5 a U-shaped bearer member 4 is represented, the two warp thread supporting rails 4b of which run on both sides outside the insertion area AB in parallel with the direction of motion of the grippers. In contrast to FIG. 3, in the embodiment in accordance with FIG. 5 the two warp thread supporting rails 4b are one constituent of a single bearer member 4. The bearer member 4 exhibits a connection between the warp thread supporting rails 4b, the surface 4a of the bearer member 4 next the warp threads being made, for example, as a plane area which extends between the warp thread supporting rails 4b in the direction of motion of the grippers. The two warp thread supporting rails 4b project above the area 4a by at least 1 mm so that during the weft yarn insertion the area 4a exercises no supporting function upon the warp threads 7b of the lower shed. But with the loom at standstill and the warp threads 7b at least slightly slackened it may, for example, in partial regions of the area AB, be possible for warp threads 7b and a gripper 3 which is perhaps lying on them, to rest upon the area 4a of the bearer member 4.

In order to avoid or reduce the deposit on the area 4a of particles caused by friction it may prove advantageous to provide the bearer member, for example, in the direction of gravity, with openings such as drilled holes, shown as DH in FIG. 5 the said particles are led away via the openings.

Both in the arrangement in accordance with FIG. 3 and in accordance with FIG. 4 and FIG. 5 each of the bearer members 4 or 5 may be arranged in such a way that in the position for weft yarn insertion they touch the lowlevel warp threads 7b in support or else exhibit a small clearance in which case the clearance may lie in a range of up to one millimeter so that the supporting elements 4 and/or 5 act in support only in the case of correspondingly greater deflections. For example, holes of 0.5 mm may be used.

Depending upon the properties of the warp threads 7a, 7b and further supporting devices like the cloth supporting rail 6d or heald eyes 12b it may even be sufficient to provide only one additional bearer member 4 or 5 for the additional support of the warp threads 7b.

The bearer members 4 and 5 may in turn also exhibit springy or resilient properties and be produced from metallic materials or from plastics.

In the present embodiment the device in accordance with the invention has always been described in connection with a rapier tape gripper loom. But the device in accordance with the invention is equally suitable for rapier gripper looms.

I claim:

1. In a gripper loom including:

a shed defined from a beat up edge of cloth being woven, said shed including upper and lower warp threads;

a rapier tape having inserter rapier tapes and gripper heads for the insertion of weft yarn in said shed between said upper and lower warp threads in a direction along an insertion path having an insertion length equal to the width of shed in said gripper loom along a path width across said warp threads over which said gripper heads pass;

the improvement comprising;

at least one bearer member supporting the lower warp threads along at least part of the width of shed outside the path width across said lower warp threads over which the gripper heads pass;

said lower warp threads over at least part of the insertion width of the shed acting exclusively as direct support to the gripper heads during the insertion of the weft yarn.

2. The gripper loom of claim 1 further comprising:

said at least one bearer member supports the warp threads in a region of the center of the warp threads; and a guide track supports the warp threads between said region in the center of the weave and two selvedges on either side of said cloth.

3. The gripper loom of claim 2 and further comprising:

two bearer members which are connected in a U-shape, said U-shape running in parallel with the direction of weft insertion to support the warp threads on both sides outside the path width across the lower warp threads.

4. The gripper loom of claim 3 further comprising:

between the two warp thread bearer members the bearer members define an area running in the direction of weft insertion with the clearance between the upper edges of the warp thread bearer members and the defined area being at least 1 mm.

5. The gripper loom of claim 1 further comprising:

said at least bearer member define a plane area supporting the warp threads, the width of said plane area is to up to one width of one gripper head.

6. The gripper loom of claim 1 further comprising:

the at least one bearer member is fitted adjoining a reed next to the cloth beat up edge.

7. The gripper loom of claim 1 further comprising:

the at least one bearer member is fixed to a loom frame next to heald eyes at the ends of said warp threads.

8. The gripper loom of claim 1 further including:

the bearer member is fastened to a sley on a side next to heald eyes.

9. The gripper loom of claim 1 further including:

an additional bearer member is arranged in the direction of the weft yarn between the insertion path and a cloth-supporting rail.

10. The gripper loom of claim 9 further including:

the additional bearer member is made as a warp thread bearer rail having an upper supporting edge, the supporting upper edge of which during the insertion of weft yarn exhibits a clearance of up to 0.5 mm from the lower warp threads.

11. The gripper loom of claim 9 further including:

the additional bearer member is made as a warp thread bearer rail having an upper supporting edge, said upper supporting edge touching the warp threads during the insertion of weft yarn.

12. The gripper loom of claim 1 further including:

holes defined in said at least one bearer member to impede the accumulation of particles of dirt.

* * * * *